US011255531B2

(12) United States Patent
Schorr, III

(10) Patent No.: US 11,255,531 B2
(45) Date of Patent: Feb. 22, 2022

(54) REMOTE CONTROL ARM-MOUNTED FLASHLIGHT

(71) Applicant: Jerome Otto Schorr, III, Bel Air, MD (US)

(72) Inventor: Jerome Otto Schorr, III, Bel Air, MD (US)

( * ) Notice: Subject to any disclaimer, the term of this patent is extended or adjusted under 35 U.S.C. 154(b) by 0 days.

(21) Appl. No.: 16/892,364

(22) Filed: Jun. 4, 2020

(65) Prior Publication Data

US 2020/0309358 A1 Oct. 1, 2020

Related U.S. Application Data

(63) Continuation-in-part of application No. 16/398,973, filed on Apr. 30, 2019, now Pat. No. 10,677,436.

(60) Provisional application No. 62/664,516, filed on Apr. 30, 2018.

(51) Int. Cl.

| | |
|---|---|
| ***F21V 23/04*** | (2006.01) |
| ***A41D 1/00*** | (2018.01) |
| ***F21V 21/08*** | (2006.01) |

(52) U.S. Cl.

CPC ..... *F21V 23/0435* (2013.01); *A41D 1/002* (2013.01); *F21V 21/0816* (2013.01); *F21V 23/0414* (2013.01)

(58) Field of Classification Search

CPC ..... A41D 1/00; A41D 1/02; F21V 23/0435
USPC ..... 2/162
See application file for complete search history.

(56) References Cited

U.S. PATENT DOCUMENTS

| | | | | |
|---|---|---|---|---|
| 455,972 A ‡ | 7/1891 | Oudin | A61B 1/06 600/24 |
| 914,975 A ‡ | 3/1909 | Radley | F21V 7/09 362/31 |
| 1,015,715 A ‡ | 1/1912 | Schindler | F21L 4/00 340/32 |
| 1,173,269 A ‡ | 2/1916 | Heidemann | |
| 1,200,403 A ‡ | 10/1916 | Weyer | F21V 21/08 362/10 |
| 1,267,436 A ‡ | 5/1918 | Martin | A41D 19/0157 340/32 |
| 1,504,980 A ‡ | 8/1924 | Schultz | |

(Continued)

FOREIGN PATENT DOCUMENTS

| | | | |
|---|---|---|---|
| DE | 102012022420 A1 ‡ | 6/2014 | F21L 4/00 |
| JP | 2013145658 A ‡ | 7/2013 | |

*Primary Examiner* — Timothy K Trieu

(74) *Attorney, Agent, or Firm* — Royal W. Craig; Gordon Feinblatt LLC

(57) ABSTRACT

A remote finger switch device and arm mount for an electrical lighting accessory, such as a flashlight, and operation thereof from the finger switch. The switch device can include a remote control unit in electrical contact with the end of a flexible cable. The remote control unit can include an integral finger mount for attachment to a finger of the user. An arm-mount for the flashlight is also disclosed, and includes a wraparound strap, and an arm panel attached to the strap and bearing a Picatinny rail. A base attached to the flashlight clamps tongue-in-groove to the Picatinny rail. The flexible cable can include one end in electrical contact with the remote control unit and a second end in electrical contact with a first connector adapted for being electrically connected to a complementary second connector on the arm-mounted electrical lighting accessory.

10 Claims, 6 Drawing Sheets

(56) References Cited

U.S. PATENT DOCUMENTS 1,532,493 A ‡ 4/1925 Ivie
1,553,860 A ‡ 9/1925 Hopper
1,754,570 A ‡ 4/1930 Pickett
1,769,241 A ‡ 7/1930 Stephani
2,024,281 A ‡ 12/1935 Gaskin
3,112,889 A ‡ 12/1963 Marmo et al.
3,638,011 A ‡ 1/1972 Bain et al.
3,811,684 A ‡ 5/1974 Tredway, Sr.
4,422,131 A ‡ 12/1983 Clanton ..... F21V 23/0414 200/60
4,425,600 A ‡ 1/1984 Barnhart
4,521,832 A ‡ 6/1985 Barbour
4,788,631 A ‡ 11/1988 Fuller
5,086,378 A ‡ 2/1992 Prince
5,124,892 A ‡ 6/1992 Lambert
5,154,506 A ‡ 10/1992 Leard
5,183,324 A ‡ 2/1993 Thomas
5,255,167 A ‡ 10/1993 Toussaint ..... F21L 4/06 359/354
5,283,722 A ‡ 2/1994 Koenen et al.
5,345,368 A ‡ 9/1994 Huff
5,365,213 A ‡ 11/1994 Paull ..... G08B 21/0297 340/32
5,448,458 A ‡ 9/1995 Smyly, Jr. ..... F21L 4/00 362/103
5,450,293 A ‡ 9/1995 Hoffman ..... A61B 1/07 362/10
5,535,105 A ‡ 7/1996 Koenen ..... A61B 42/10 362/57
5,738,432 A * 4/1998 Okko ..... A43B 1/0036 362/103
5,781,511 A ‡ 7/1998 Yasukawa ..... A61B 5/02438 368/10
5,816,676 A ‡ 10/1998 Koenen Myers ..... A61B 42/10 362/8
6,213,619 B1 * 4/2001 Yu ..... A45F 5/02 116/DIG. 44
6,270,231 B1 ‡ 8/2001 Kerr ..... F21L 15/14 362/11
6,529,121 B2 ‡ 3/2003 Bush ..... A41D 19/0157 340/32
6,592,235 B1 ‡ 7/2003 Mayo ..... A41D 19/0157 2/160
6,709,142 B2 ‡ 3/2004 Gyori ..... A41D 19/0157 362/10
6,892,397 B2 ‡ 5/2005 Raz ..... A41D 19/0157 2/160
6,902,289 B1 ‡ 6/2005 Smith ..... A41D 19/0024 362/10
7,013,490 B2 ‡ 3/2006 Senter ..... A41D 19/0157 2/160
7,152,248 B2 ‡ 12/2006 Ziemer ..... A41D 19/0157 2/160
7,434,955 B2 ‡ 10/2008 Vickers ..... F21V 23/0414 362/20
7,441,918 B2 ‡ 10/2008 Kim ..... F41G 1/34 200/18
7,549,763 B2 * 6/2009 Kim ..... A42B 3/044 248/229.12
7,819,544 B2 ‡ 10/2010 Thompson ..... A41D 19/0157 362/10
8,038,310 B1 ‡ 10/2011 Hale ..... A41D 19/0157 362/10
8,303,129 B1 ‡ 11/2012 Thielen ..... F21V 21/0832 362/10
8,550,648 B2 ‡ 10/2013 Smith
8,562,165 B2 ‡ 10/2013 Thompson et al.
8,727,556 B2 ‡ 5/2014 Swan
2004/0223321 A1 * 11/2004 Crowley ..... F21L 4/06 362/103
2008/0062676 A1 ‡ 3/2008 Masuda
2010/0096486 A1 ‡ 4/2010 Yang ..... H02G 11/02 242/37
2013/0194784 A1 * 8/2013 Yu ..... F21V 21/145 362/108
2014/0291556 A1 ‡ 10/2014 Bowers ..... F21L 4/00 250/504 R
2018/0011283 A1 ‡ 4/2018 Hayashi ..... G02B 7/025
2019/0216144 A1 ‡ 7/2019 York ..... F21V 21/14

* cited by examiner
‡ imported from a related application

REMOTE CONTROL ARM-MOUNTED FLASHLIGHT

CROSS-REFERENCE TO RELATED APPLICATION(S)

The present application is a continuation-in-part of Ser. No. 16/398,973 filed 30 Apr. 2019 (now U.S. Pat. No. 10,677,436), which in turn derives priority from U.S. Provisional Patent Application No. 62/664,516 filed 30 Apr. 2018.

BACKGROUND OF THE INVENTION

1. Field of the Invention

The present invention relates generally to arm-mounted flashlights and, more particularly, to a wrist mount configured for removably mounting a conventional flashlight and with a distal finger-tip remote control that is attached to the user's finger to allow the user to power the light unit on/off and/or switch between multiple lighting display modes.

2. Description of the Background

Flashlights are commonly used in a wide variety of situations to illuminate areas where normal lighting is not readily available. The conventional solution is to hold a flashlight or use a headlamp to create the desired lighted area. Although wrist-mounted flashlights and holsters to attach handheld flashlights to the arm are also available, they are less commonly used in most situations. These devices all require the user to fully occupy at least one hand with the operation of the flashlight when they want to turn it on, off, or cycle through different lighting modes.

Many people including military personnel, police, firemen, campers, hikers, mechanics, fishermen, hunters, electricians, etc. often find themselves in a situation where they need a flashlight but need to use the hand that would otherwise hold and operate the flashlight. For example, in the case of a policeman, he may need to use a flashlight while holding a firearm with both hands. Both hands may be necessary to keep a steady aim on the intended target. Unless he removes at least one hand from the firearm, he would have difficulty in activating the flashlight. In another example, a camper may be assembling a tent in the dark and need to use a flashlight while holding multiple parts of the tent assembly. The camper can continue to use both hands while activating the flashlight as he assembles the tent. In yet another example, various types of switch apparatus are used for firearm-mounted flashlights with tail cap switches or pressure actuable tape switches. The flashlight beam is limited to the parallel path of the firearm and can only be used while the firearm is present.

It would be greatly desirable to allow such persons to use a flashlight without removing any hands from the current task. There are a number of patents that show wrist-mounted, hand-mounted and arm-mounted flashlights. For example, U.S. Pat. No. 4,788,631 improves on the standard wrist-mounted flashlight by incorporating a sliding lens with white and red sections that engage the electrical contact with the batteries and energize the light.

U. S. Pat. App. No. 20080062676 incorporates lighting components that can be easily attached or detached from a user's fingers allowing the light to illuminate the area around the user's hand. Light gloves have also been introduced in Japanese Pub. No. 2004-316050, Japanese Utility Model Reg. No. 3057778, Japanese Pub. No. HEI 7-323097, and Japanese Utility Model Reg. No. 3114125 that are configured so that the lighting components such as fairy lights or light-emitting diodes (LEDs) are attached to the finger parts of the gloves. As a result, these lighting devices provide varying amounts of light in the vicinity of the hand, but none of them provide an easy single-finger mounted switch to remotely operate a wrist-mounted flashlight with a significant light source while continuing to work without interrupting the hand from its normal activity.

There have been several efforts to improve flashlight systems that include flashlights and signaling lights into hand, arm and wrist attachments. For example, U.S. Pat. Nos. 1,173,269, 1,267,436 and 5,365,213 include bulky devices with activating switches that are incorporated into gloves, wrist attachments and larger body attachments that require excessive components and limit the use and operation of the devices. As a result, none of these provide an easy finger mounted switch to remotely operate an arm-mounted flashlight with a significant light source while continuing to work without interrupting the hand from its normal activity.

There have also been efforts to improve flashlights that attach to firearms and their associated rail mounting systems. For example, U.S. Pat. No. 7,441,918 B2 improves on the standard firearm mounted flashlight by including a remote switch that attaches to the rail structure connected to the firearm. The remote switching apparatus allows someone who is holding a firearm to more effectively operate the flashlight while also operating the firearm. As a result, this flashlight system is also deficient since the firearm and its secured attachments are all required to be present to maintain operation of the flashlight.

In general, the prior art suffers from a common deficiency in that they require the user to occupy one hand to turn the beam on or off or to otherwise control the beam's color, diffusion angle, etc., and the beam must be diverted. What is needed is a remote control switch device for an arm-mounted flashlight that is securable to a user's finger to allow the user to operate the flashlight via their fingertips, and thereby illuminate a target while leaving both hands free to work on the target, and moreover to keep the beam directionally trained on the target while controlling the beam. The prior art for wrist or hand/arm-mounted flashlight systems also commonly force the user to utilize specific lighting elements that are incorporated into the available device. Different use requirements, situations and operator personal preferences often direct the selection of particular flashlights and types of switches.

Thus, it would be greatly advantageous to provide a switch device for an arm-mounted flashlight with a method of simple operation via a remote control unit that is attached to the user's finger.

SUMMARY OF THE INVENTION

Objects of the present invention include the following:

It is an object of the present invention to provide a wrist-mount and remote control switch device for arm-mounted electrical lighting accessory, such as a flashlight.

It is another object of the present invention to provide a remote electrical push button switch, tape switch or capacitive touch switch and associated housing wherein said switch can attach to the user's finger and can be conductively connected to the arm-mounted flashlight via a flexible cable to a plug that is removably connectable to the flashlight jack, tail cap jack or similar interface with optional pushbutton switch.

It is still another object of the present invention to provide a simple push button or tap mode-select operation switch that a user can operate to select one of a number of flashlight modes by simple depression or touch of the remote control switch attached to the user's finger. The modes may include bright illumination modes, an emergency signaling mode, a rapid disorienting flash mode, other unique lighting modes selected by the user. In some embodiments, the modes may include a mode to operate a single light activation without multiple modes of illumination.

It is still another object of the present invention to provide an optional tail cap assembly that includes a pushbutton switch in addition to the jack for the remote control switch.

It is still another object to provide a wrist-mount for the flashlight configured for removable-mounting.

It is still another object of the present invention to provide an optional tail cap assembly wherein said remote control switch attaches to the user's finger and is conductively connected to the arm-mounted flashlight via a flexible cable to a plug that is connectable to a tail cap jack or which serves as the tail cap with or without an optional pushbutton switch.

In accordance with the foregoing objects, the invention is an arm-mount for a conventional flashlight and a remote control unit that attaches to the finger for allowing the user to control the flashlight by finger or by the switch in the tail cap assembly. The remote control may allow the user to power the light unit on/off and/or switch between multiple lighting display modes using their fingertips. By providing a means to remotely activate the flashlight, the invention can free both hands of the user or at least all of the fingers except the one used to activate the flashlight. A consumer can use the arm-mounted light of their choice more effectively and economically instead of purchasing limited use items as he or she would have to with the prior art.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is a wrist-mount and remote control switch device that turns a conventional-style flashlight into a hands-free arm-mounted flashlight with convenient fingertip activated illumination.

The wrist-mount includes a wrist strap bearing a Picatinny or similar rail. The Picatinny rail is a bracket that provides a standard mounting platform for various flashlight sizes or any other devices. The Picatinny rail facilitates the attachment of the flashlight via a clamping mount oriented ninety degrees to the axial orientation of the flashlight (along the arm). The flashlight is attached on one side of a base, and the clamping mount is exposed on the other side of the base underneath the flashlight. The clamping mount generally includes a rail engaging bracket and a clamp by which the clamping mount can be securely mounted directly on the Picatinny rail to secure the flashlight atop the wrist.

The remote control generally comprises a remote switch including housing having a resilient yoke adapted to securely grasp a finger on the user's hand for retaining the housing to the finger. The remote control is wire-connected to the arm-mounted flashlight via a flexible cable, preferably to a plug that is removably or permanently inserted into the tail of the flashlight as a surrogate for the OEM tail cap. The remote control minimally allows the user to power the light unit on/off by thumb and forefinger, but may also allow switching between various lighting colors, diffusion angles/patterns, other display modes or alternate functions. The remote control switch device for an arm-mounted flashlight enables a user to directionally train the beam on the target, use both hands to work on the target, and additionally power the beam on/off, etc. without diverting the flashlight beam from the target.

Figure 1:
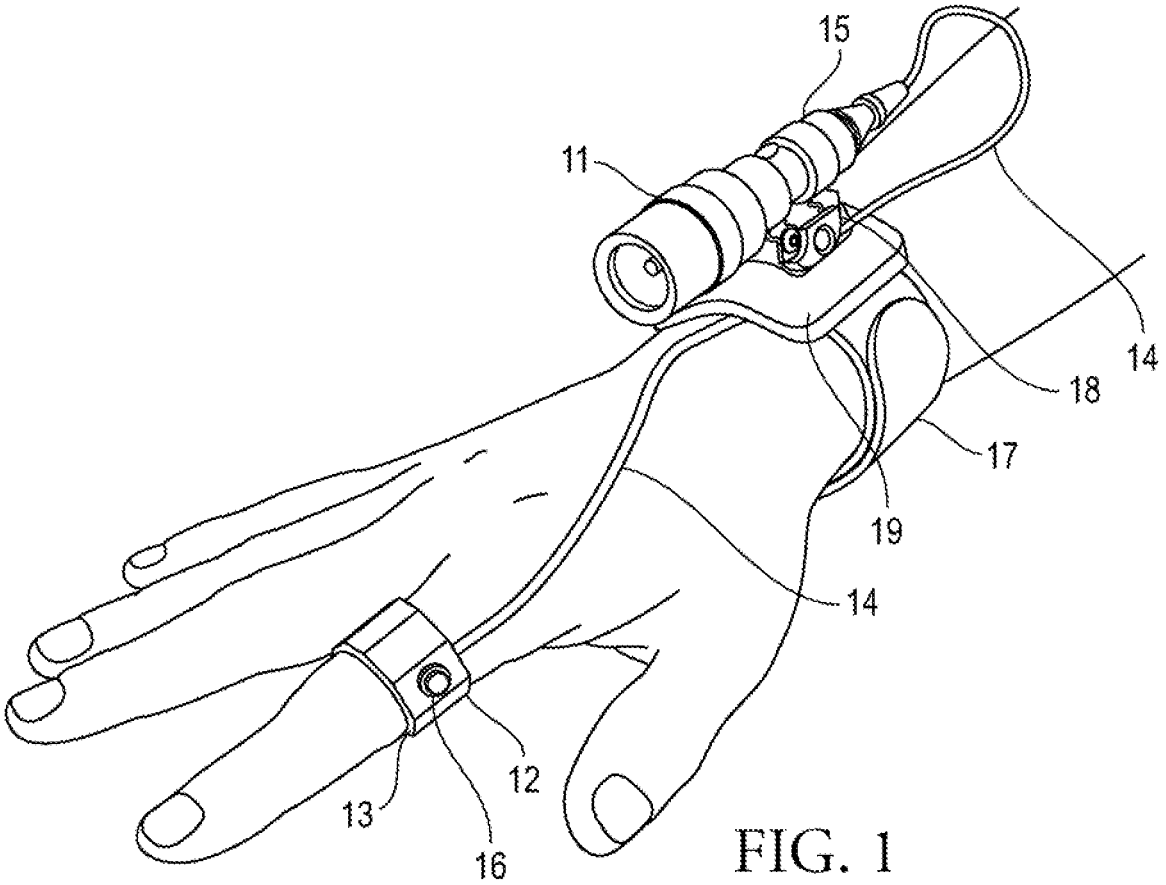
FIG. 1 shows a perspective view of the exemplary arm-mounted flashlight and remote control switch secured to a user's finger, all in accordance with the preferred embodiment of the present invention.

FIG. 1 shows an example of a flashlight 11, which may be any conventional flashlight, non-standard flashlight, lighting unit, target illuminator, or any other compact device. Flashlight 11 is mounted atop a wrist strap 17 and held captive therein atop the wrist and pointing longitudinally. Flashlight 11 is connected to a remote control unit 12 via a flexible cable 14, which may be any suitable electrical cable, preferably an insulated multi-conductor cable, ribbon cable, coiled cable with shape-memory quality, or the like. In an embodiment, the flexible cable 14 connects to the flashlight 11 by a surrogate tail cap 15 that replaces the existing tail cap of the flashlight 11. Alternatively, the flexible cable 14 may connect to the flashlight 11 by a plug-and-receptacle type connection built into the existing tail cap 15 or flashlight 11. The flashlight 11 is attached to the wrist strap 17 by a Picatinny rail mount 50 that facilitates removable attachment of the flashlight 11. The flashlight 11 is attached atop a base 18, and the base 18 includes a downwardly-directed clamping mount that attaches to a Picatinny rail 50 atop a wrist panel 19 to secure the flashlight atop the wrist. The wrist panel 19 is configured to be secured by strap 17 around the wrist or distal portion of the arm or hand of the user. The remote control unit 12 is configured to be attached to the finger via an annular ring 13, or resilient half-yoke sections or other suitable finger connection. The remote control unit 12 can include a power switch 16 to power the flashlight 11 on/off and may optionally and additionally include switch(es) for switching between multiple lighting display modes, colors and/or diffusion patterns, or other functions.

Figure 2:
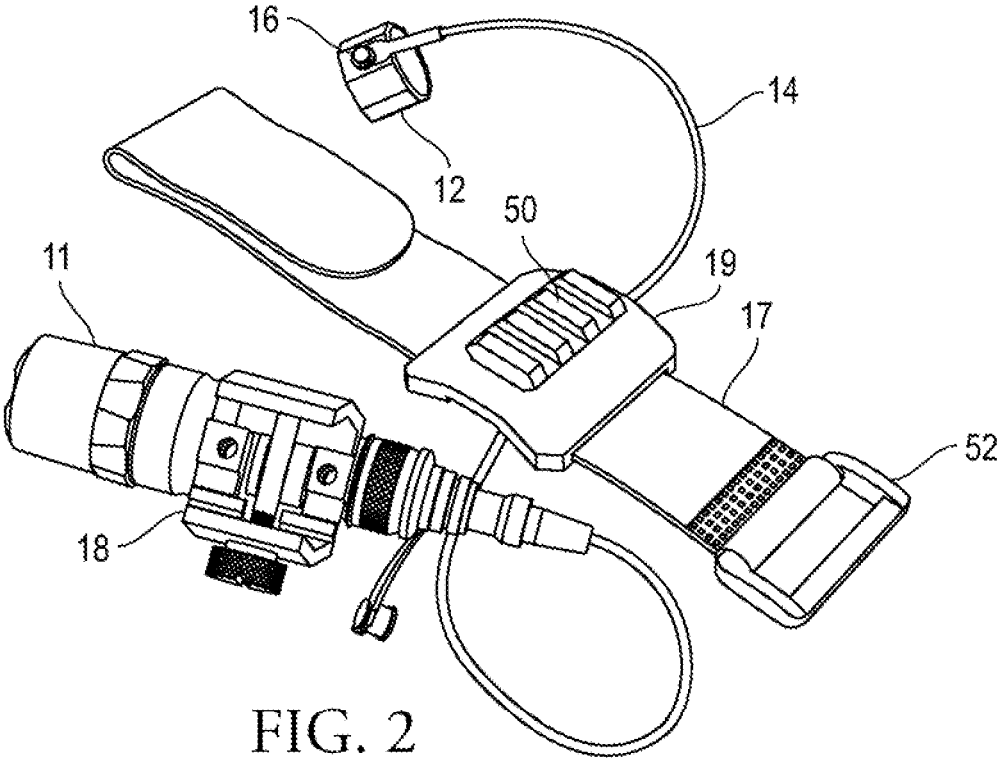
FIG. 2 shows a side view of the exemplary flashlight, wrist-mount and switch device with remote control switch, flexible cable, and flashlight rear or tail cap assembly.

The remote control unit 12 can connect to the flashlight 11 via flexible cable 14. As can be seen in FIG. 1, the switch 16 on the remote control unit 12 may be operated by pressing with either adjacent finger to power the flashlight 11 on and/or off without disrupting the orientation of the beam emanating from the flashlight 11. FIG. 2 shows a side view of the exemplary remote control unit 12 with switch 16 for the arm-mounted flashlight 11 of FIG. 1, without being mounted to a user.

Figure 3:
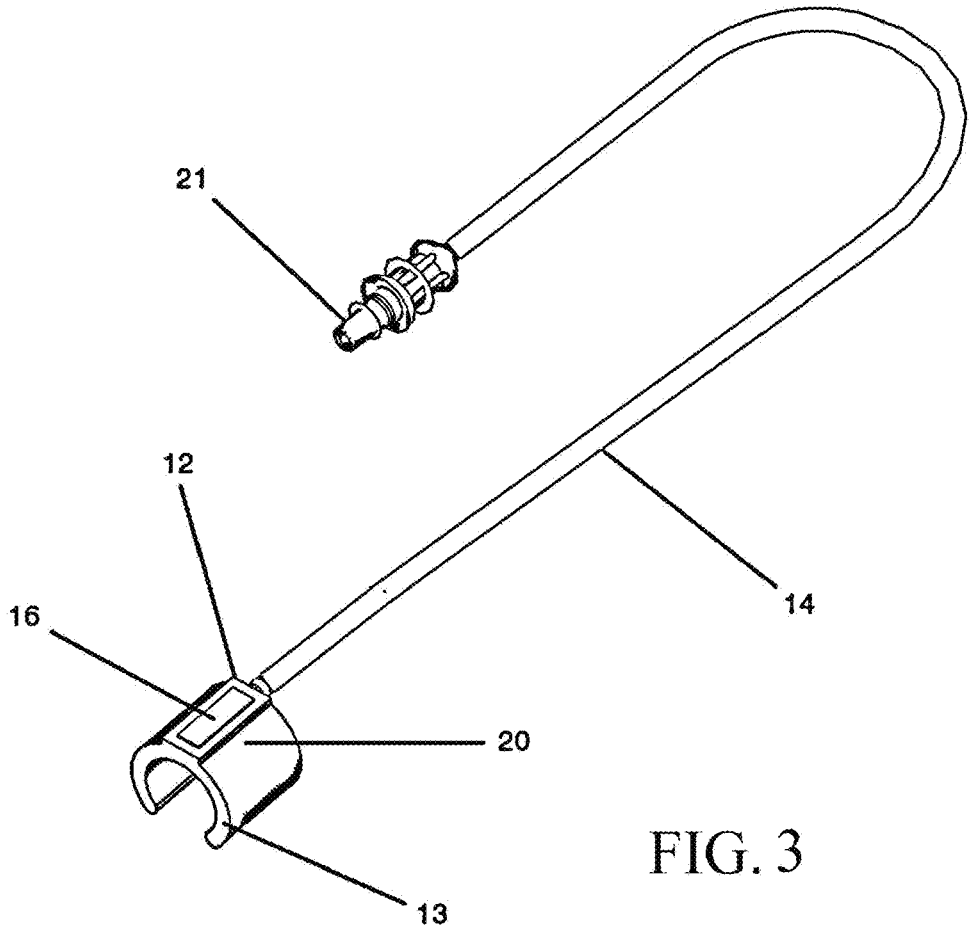
FIG. 3 shows a perspective view of the remote control unit, flexible cable and tail cap assembly plug of the present invention that attaches to an arm-mounted flashlight assembly.
Figure 5:
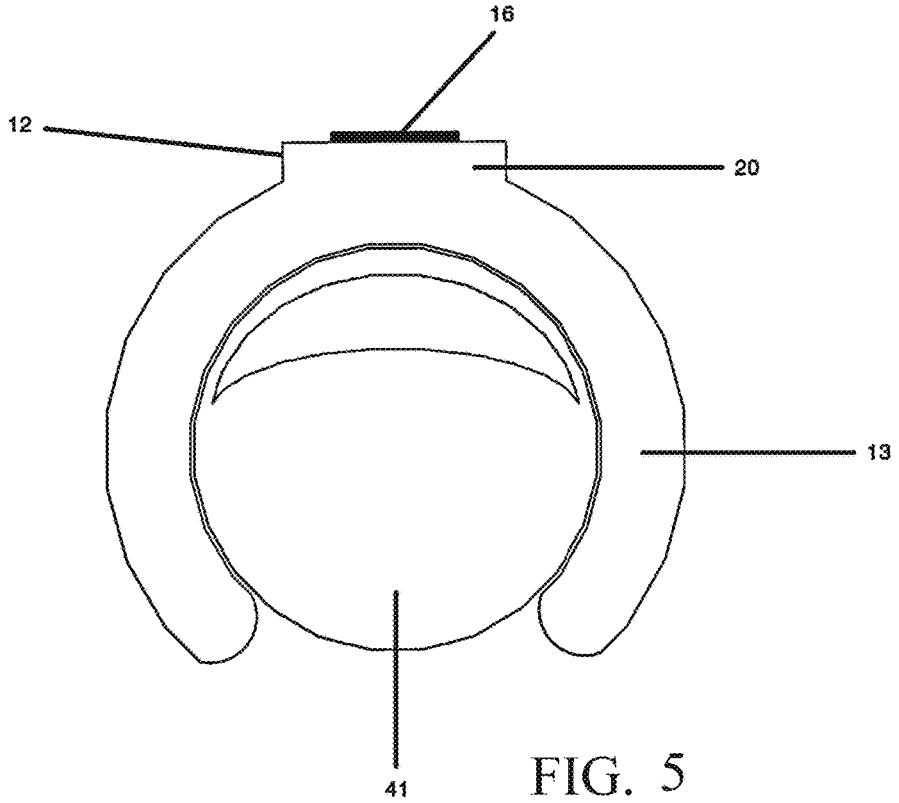
FIG. 5 shows a cross-sectional view of the remote control switch housing mounted to a user's finger.

FIGS. 3 and 5 show detail views of the remote control unit 12 which is preferably mounted atop a resilient two-prong flexible annular ring 13. The remote control unit 12 minimally comprises an enclosed electrical detent switch, tape switch or capacitive touch switch 16 incorporated into a sealed housing 20 attached to the ring 13 that is further configured to be attached to a finger. The flexible cable 14 can be electrically connected to remote control unit 12 and is further connected to the flashlight 11 via surrogate tail cap or plug-in-receptacle connection to the tail cap 15.

Figure 4:
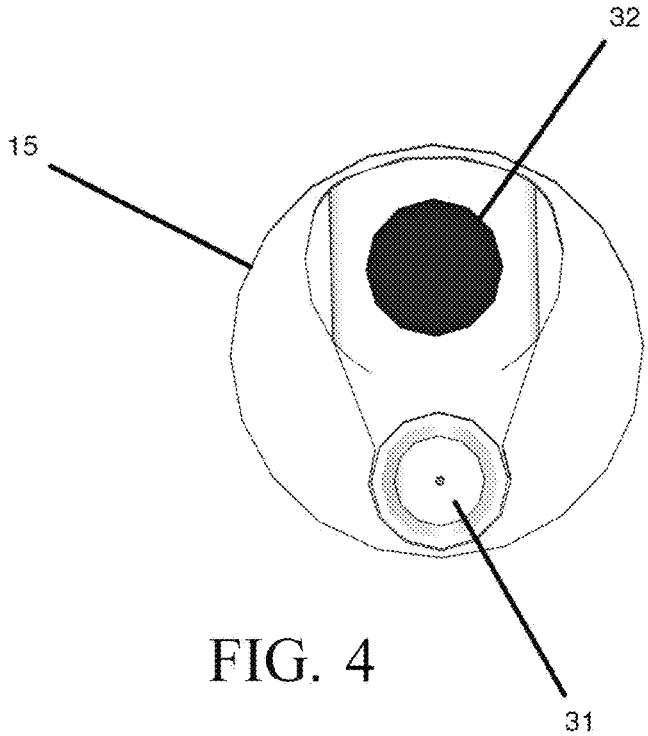
FIG. 4 shows a rear view of the tail cap assembly that includes a flexible cable mounting point and an optional pushbutton.

FIG. 4 shows an exemplary view of a tail cap assembly 15 that allows a first connector 21 of flexible cable 14 to be electrically connected to a complementary second connector 31 of tail cap assembly 15. The connection may be, for example, an optional plug-in-receptacle type connection including a female jack 31 in tail cap assembly 15, to which the remote control unit 12 may be connected via a male plug 21 on flexible cable 14 which is inserted therein. The tail cap assembly 15 may also be hard-wired to the connector device or jack 31 and may screw into the flashlight as a surrogate for the existing OEM tail plug. In addition, however, the tail cap assembly 15 further includes an optional second switch 32, such as a pushbutton detent actuator or other pressure actuatable switch, secured in the tail cap assembly 15.

Figure 6:
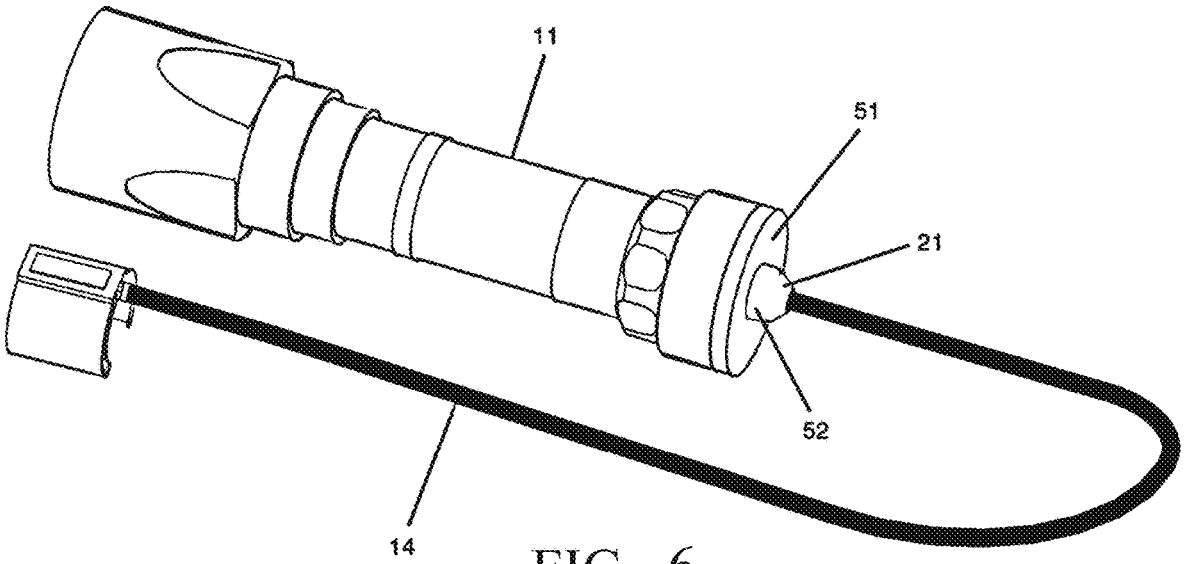
FIG. 6 shows a perspective view of an optional configuration of the switch device for arm-mounted flashlight with remote control switch having a flexible cable, and a removable cable mounting point to the flashlight rear, and without a tail cap assembly.

FIG. 6 shows an alternative embodiment of the invention where there is no separate tail cap assembly 15 that plugs into the flashlight 11. Instead, the flexible cable 14 enters the rear wall 51 of the flashlight 11 via a small coupling receptacle 52 with a connector device or plug 21 where it is impermanently secured.

Figure 7:
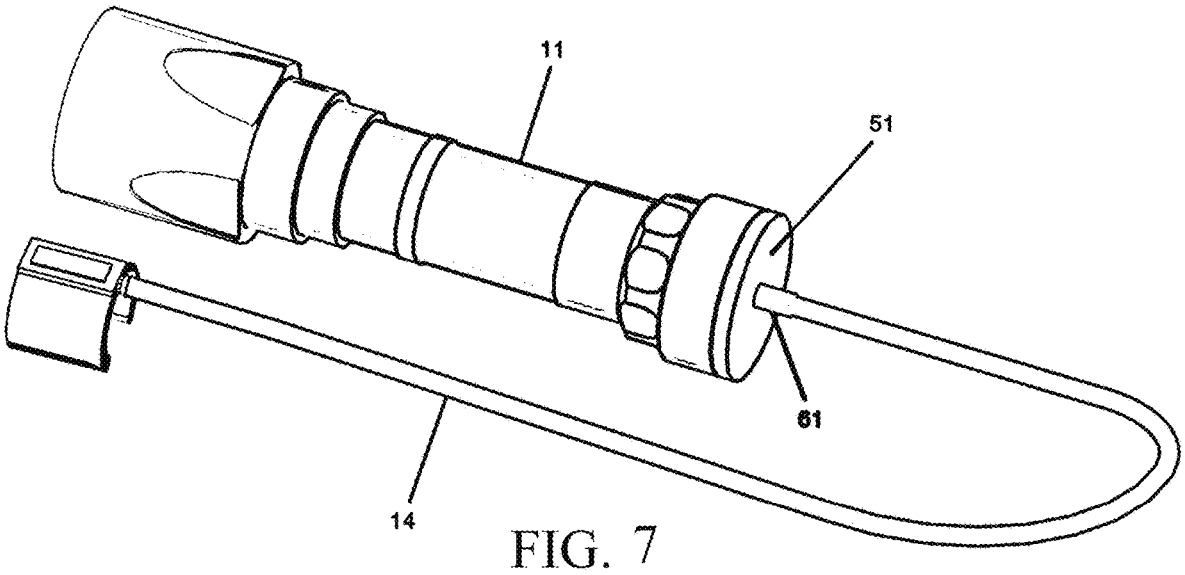
FIG. 7 shows a perspective view of an optional configuration of the switch device for arm-mounted flashlight with remote control switch having a flexible cable with permanent cable mounting point to flashlight rear without tail cap assembly.

FIG. 7 shows another alternative embodiment of the invention where there is no separate tail cap assembly 15 that plugs into the flashlight 11. Instead, the flexible cable 14 enters the rear wall 51 of the flashlight 11 via a small coupling port 61 where it is permanently secured.

Figure 8:
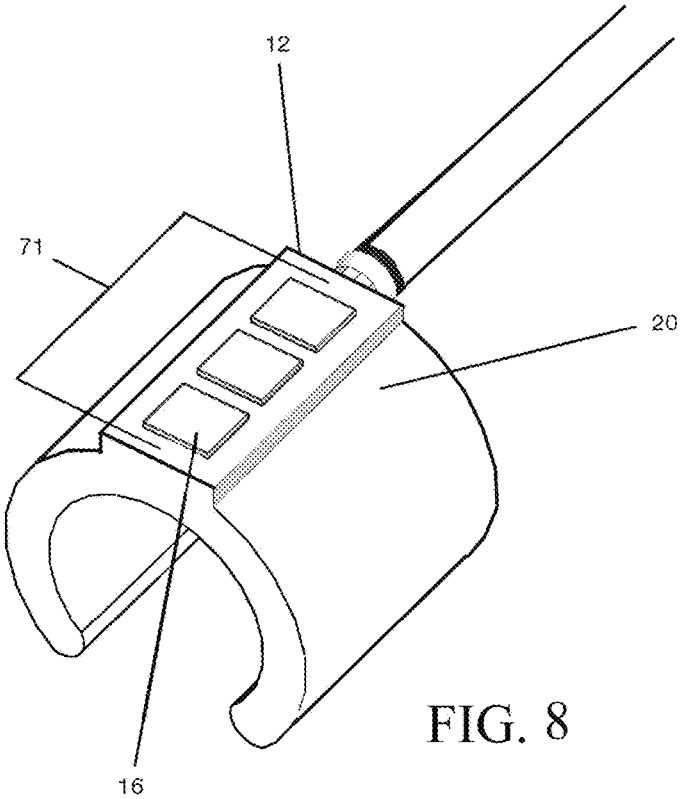
FIG. 8 shows a perspective view of an optional configuration of the remote switch housing with multiple control switches for selecting different flashlight operating modes or alternate functions.

FIG. 8 shows yet another alternative embodiment where the remote control unit 12 is not limited by the use of one button or switch 16 to cycle through various modes. Instead, the singular remote control switch 16 is replaced by multiple remote control switches 71 in the sealed housing 20. Multiple remote control switches 71 allow the user to power the light unit on/off, but may at the same time also allow switching between various lighting colors, diffusion angles/patterns, multiple display modes, or other functions.

Referring back to FIG. 2 the flashlight 11 is attached to the wrist strap 17 by a Picatinny rail mount 50 that facilitates removable attachment of the flashlight 11. The Picatinny rail mount 50 includes a base 18 to which flashlight 11 is attached on one side. The base 18 clamps to the wrist panel 19 via Picatinny rail 50 as seen in FIG. 10.

Figure 9:
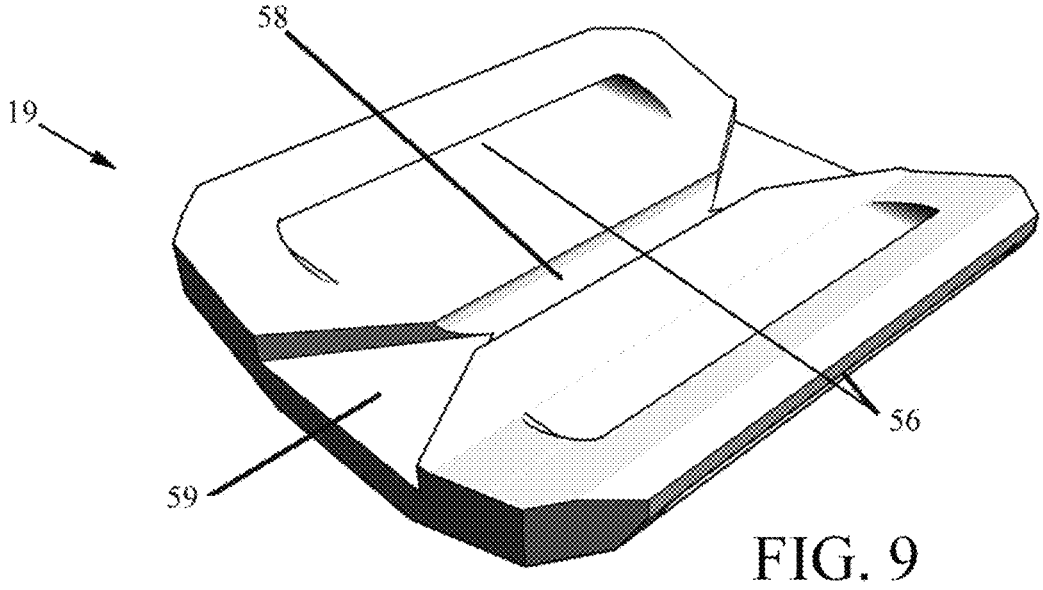
FIG. 9 shows a bottom perspective view of the wrist panel.
Figure 10:
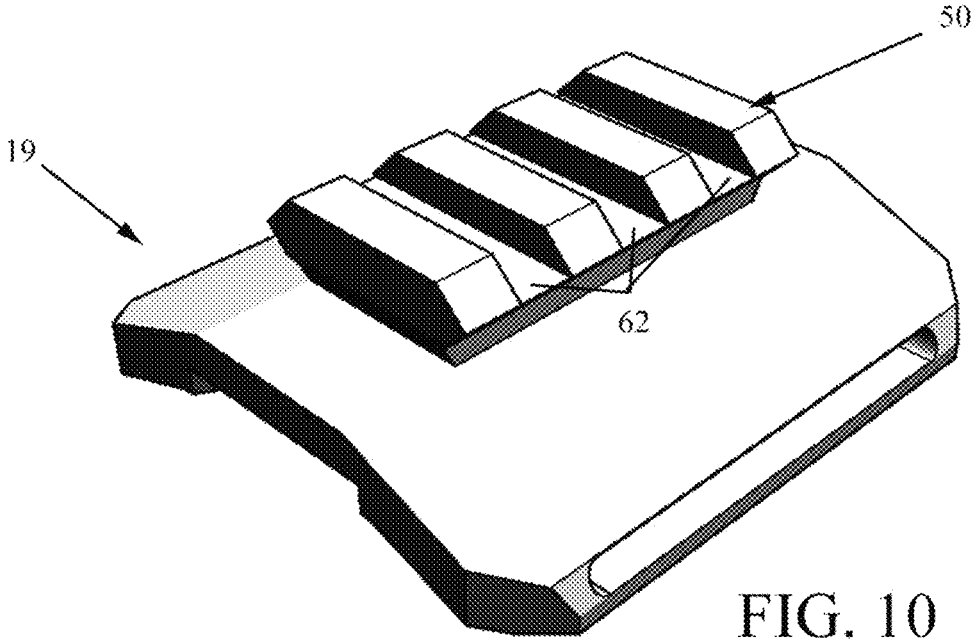
FIG. 10 shows a top perspective view of the wrist panel.
Figure 11:
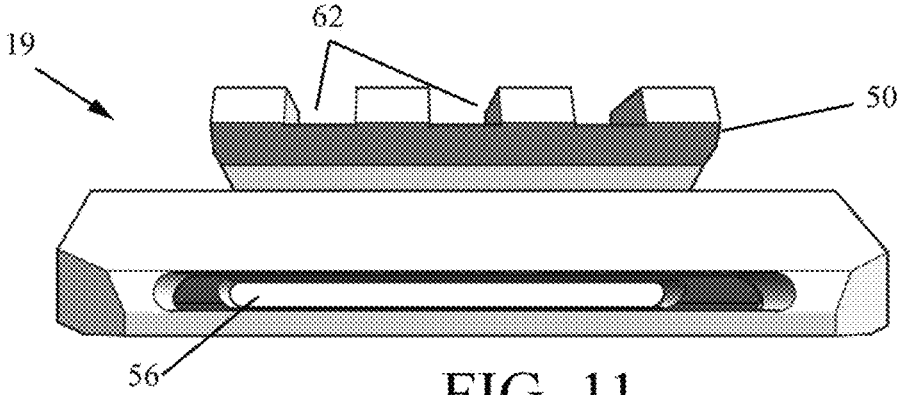
FIG. 11 shows a side view of the wrist panel.

Referring collectively to FIGS. 9-11 the wrist panel 19 generally comprises a trough-shaped member having an angular or curved concave underside so as to conform to the curve of the wrist or arm. The wrist panel 19 seats atop the wrist/arm and extends axially from end-to-end, arching from side-to-side. Opposing slotted stirrups 56 are offset slightly inward along each side allowing passage of the wrist strap 17. In use the stirrups 56 pass a portion of the strap 17 that passes over the wrist. The increased tension on the stabilizing strap 17 applies compression against the wrist and thereby stabilizes the flashlight 11. In addition, a fluted channel 58 runs end-to-end across wrist panel 19 to seat the flexible cable 14 connecting the flashlight 11 to remote control unit 12. Channel 58 preferably has a semi-circular cross-section and an arc within a range of from 180-200 degrees so that cable 14 can be press-fit therein and will not come free without force. In addition, the diameter of channel 58 is greater than that of cable 14 so that cable 14 remains free to slide axially within channel 58. The channel 58 is fluted at both ends by inwardly-tapering V-shaped slots 59 so that when the cable 14 is seated in channel 58 it has a limited degree of room to flex within the slots 59. This reduces chafing, wear and breakage. In use the wrist strap 17 runs between the cable 14 and the wrist panel 19 and adds comfort and protection for the user's wrist.

Flipping the wrist panel 19 over as seen in FIG. 10, the Picatinny rail 50 is exposed. Picatinny rail 50 generally comprises a raised rail attached to (or integrally formed with) wrist panel 19, and keyed to the base 18 to which flashlight 11 is attached for tongue-in-groove insertion thereon. In an embodiment the Picatinny rail 50 runs axially along wrist panel 19 and is formed with intermittent hexagonal/trapezoidal cross-sections to define a succession of outwardly-disposed keyslots 62 along its face for indexing the base 18.

One skilled in the art should understand that any other suitable rail configuration may be used including a Modular Lock ("M-LOK") firearm rail interface system developed and patented by Magpul Industries™, a KeyMod universal rail, MIL-STD-1913 accessory rails, and the like.

As seen in FIG. 2 the wrist strap 17 is simply a length of webbing with a loop 52 sewn at one end for passing the other end, and opposing hook-and-loop at the other end for securement onto itself.

Figure 12:
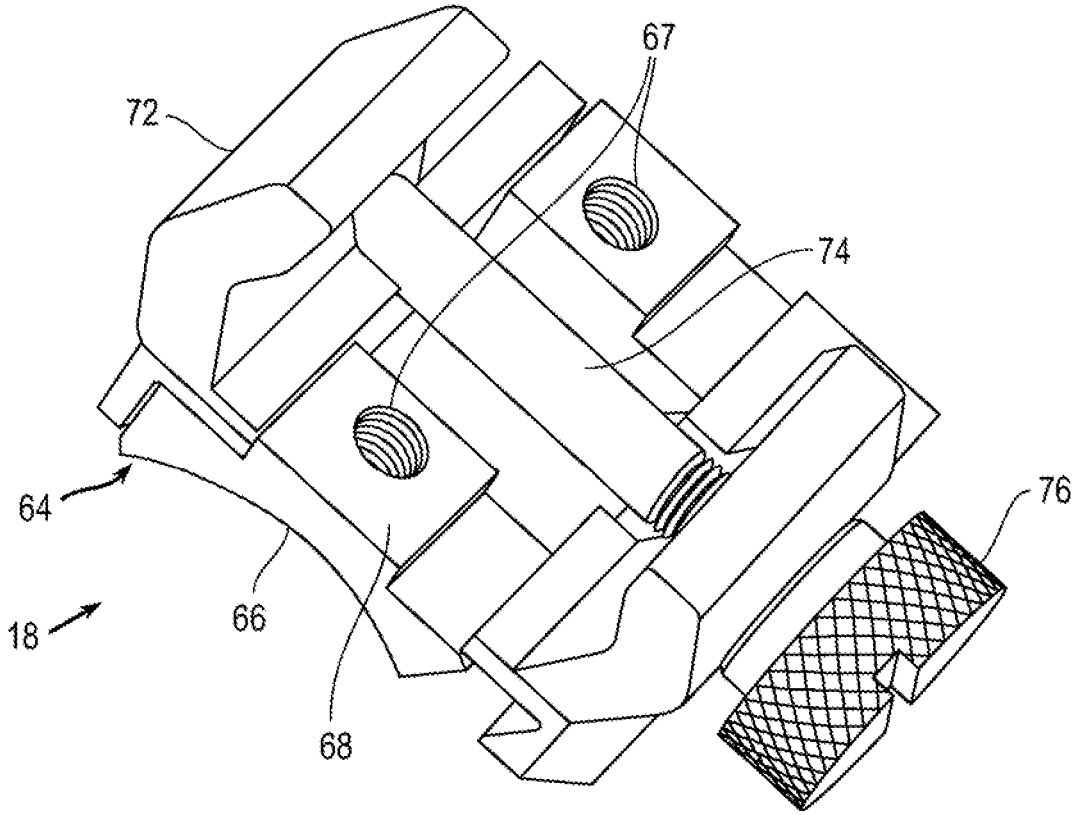
FIG. 12 shows a perspective underside view of the clamp-mount base.

FIG. 12 shows the base 18 for mounting the flashlight 11 to the wrist panel 19. The base 18 includes a saddle 64 formed with a concave trough 66 on one side for seating the cylindrical flashlight, and a keyed chuck 68 for tongue-in-grove screw attachment to the base 18. The chuck 68 is shown with two screw holes 67 for affixing the flashlight 11 to the chuck 68. The base 18 is formed with two opposing parallel walls 72 that define a groove, and walls 72 are inwardly-angled to conform to the hexagonal Picatinny rail 50 for slidable tongue-in-groove insertion thereon. A post 74 straddles the two walls 72, being anchored at one end in one wall 72 and having a threaded distal section traversing and protruding from the other wall 72. A thumb wheel 76 is screwed onto the distal end of the post 74 and bears against the wall 72 such that tightening thumb wheel 76 compresses the walls 72 together onto Picatinny rail 50, thereby fixing the axial position of the base 18 and hence flashlight 11 along the length of the rail 50. Conversely, loosening thumb wheel 76 allows the walls 72 to separate, thereby allowing readjustment of the axial position of the base 18 and flashlight 11 along the length of the Picatinny rail 50. With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. In all such cases, the result is a more aesthetically pleasing or customized for appearance or practical, functional purposes remote control switch for arm-mounted flashlight in a commercially manufacturable configuration that modifies the aesthetics and/or appearance while preserving the integrity and functional structure of the remote switch assembly so as not to depart from established standards.

For the purposes of this disclosure, unless expressly stated otherwise: (a) the use of singular forms of terms include plural forms; (b) the use of the terms "including," "having," and similar terms are deemed to have the same meaning as "comprising" and thus should not be understood as limiting.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. An arm-mount comprising:

a wraparound strap;

a wrist panel attached to said strap, said wrist panel comprising a topside and a raised rail extending linearly along said topside, and an arched underside configured to conform to a user's arm when worn thereon; and a base having a clamping mount on a top side, said clamping mount including two opposed walls spaced apart by a groove there between, the walls being inwardly-angled to conform to said raised rail on the wrist panel for slidable tongue-in-groove fitment of the raised rail in the clamping mount.

2. The arm-mount according to claim 1, wherein said wrist panel comprises opposing stirrups for passing said wraparound strap.

3. The arm-mount according to claim 1, wherein said wrist panel comprises an elongate slot extending across a bottom side for seating a flexible cable.

4. The arm-mount according to claim 3, wherein said elongate slot is fluted at both ends.

5. The arm-mount according to claim 1, wherein said rail comprises transverse slots.

6. The arm-mount according to claim 5, wherein said groove is keyed to said rail.

7. The arm-mount according to claim 1, wherein said base comprises a post for fixation to said rail.

8. The arm-mount according to claim 7, wherein said post traverses the walls of said rail.

9. The arm-mount according to claim 8, wherein said transverse post is threaded to clamp said walls.

10. The arm-mount according to claim 9, wherein said rail is defined by a pattern of transverse slots to index an axial position of said base along said rail.

* * * * *